US005573450A

United States Patent [19]

Marko ̌ci ̌c et al.

[11] Patent Number: 5,573,450

[45] Date of Patent: Nov. 12, 1996

[54] ABRASIVE BLASTING DEVICE

[76] Inventors: Ivan Marko ̌ci ̌c, Goriška c. 5; Aleksander Gerbec, Zali breg 12, both of 65212 Dobrovo, Slovenia

[21] Appl. No.: 70,960

[22] Filed: Jun. 4, 1993

[30] Foreign Application Priority Data

Jun. 19, 1992 [SI] Slovenia ..... P-9200122
Apr. 19, 1993 [SI] Slovenia ..... P-9300204

[51] Int. Cl.[6] ..... B24C 9/00

[52] U.S. Cl. ..... 451/76; 29/81.021; 451/88

[58] Field of Search ..... 51/411, 424, 425; 29/81.021; 451/76, 88

[56] References Cited

U.S. PATENT DOCUMENTS 4,753,050 6/1988 McNabb ..... 29/81.021 X
4,984,396 1/1991 Urakami ..... 51/424
5,205,085 4/1993 Urakami ..... 51/424 X

*Primary Examiner*—Joseph M. Gorski

[57] ABSTRACT

The present invention relates to an abrasive blasting device characterized in that to the first longitudinal inlet end of the injection abrading diffuser 1 there is associated a socket 2 and to the second longitudinal inlet end of the diffuser there is associated a conduit 3. The free end of the conduit 3 is closed by a cage-like collector 4, the mantle wall thereof diverging in the direction towards the diffuser 1. In the area of connection with said bottom of the collector 4 the conduit 3 is formed with a set of radial recesses 5, the interiors of the socket 2 and the conduit 3 being mutually interconnected by means of a connection-injection pipe 6. The latter projects into the conduit 3 essentially through said bottom of the collector 4. On the outer surface of the wall of the socket 2 and in the area of its free end there is diametrally opposed arranged a pair of ribs 10 bearing a guide wheel unit 10' in each case.

7 Claims, 4 Drawing Sheets

ABRASIVE BLASTING DEVICE

Figure 1:
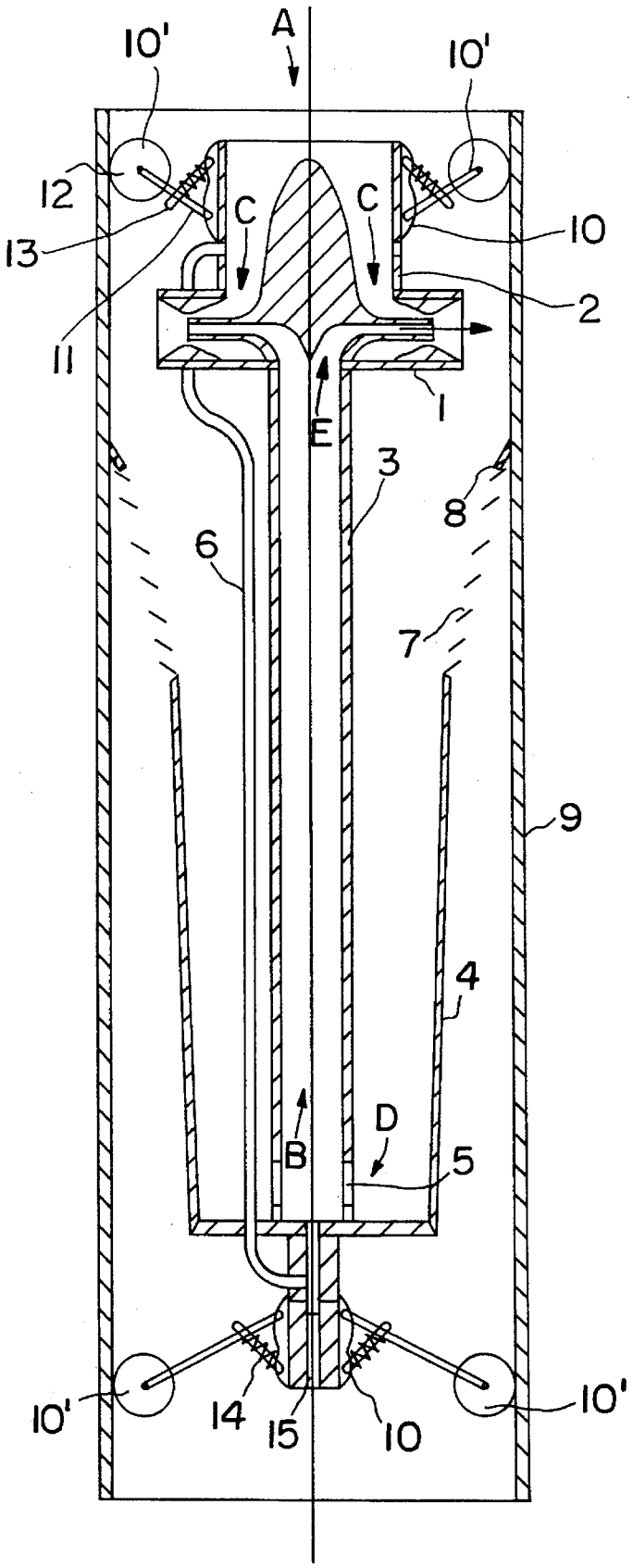

The invention belongs to the area of blasting devices for the treatment of surfaces by means of particles of abrasive material. More particularly, the subject of the invention belongs to the area of treating surfaces by means of a blast for grinding or a similar blast with any particles of abrasive material. The subject of the invention is covered by B 24 C 3/00 of the Int. Cl.

An abrasive blasting device, e.g. pipe cleaning apparatus, of the aforesaid kind is known from the U.S. Pat. No. 3,824,738. According to this device the abrasive material and the material abraded from the pipe are during the cleaning operation expelled from the open end of the pipe by an air flow created by the rotating wheel. Said device includes a carriage movable into the pipe and out of same, an abrading wheel rotatably mounted on a tubular housing carried on the forward portion of the carriage, an auger conveyer for supplying the wheel with abrasive material, and a shroud mounted behind the wheel for reducing the effective cross-sectional area of the pipe. The rotating abrading wheel is inserted in one open end of the pipe and, as it is moved through the pipe, creates an air flow which moves the abrasive material and the material abraded from the pipe out of the opposite open end of the pipe. The abrasive material is then separated from the material abraded from the pipe for reuse on subsequent pipes.

It is a disadvantage of the aforementioned device that at abrading of the pipes, the length whereof is generally within 6 and 12 m, it occupies a relatively large space. Namely, the length of the device equals at least twice the length of the pipe, i.e. the length of the pipe plus the length of the tubular housing whereto the carriage is attached, which results in relatively large ground plan areas for arranging said equipment.

Furthermore, another disadvantage of said device lies in that the length of the conveying path wherethrough the abrasive material returns from the outlet of the pipe to the collecting reservoir is relatively high, it amounting to even three to four times the length of the pipe being abraded. The result thereof is that the single parts of said conveying path are exposed to strong wear by the abrasive material so that the the lifetime thereof is essentially shorter.

It is therefore an object of the present invention to overcome the limitations and drawbacks associated with the aforesaid prior art device and to provide the shortest possible conveying path for abrasive material whereby the number of parts exposed to wear is essentially lowered, and to reduce the ground plan area of the device as much as possible.

The object according to the present invention has been attained by a collector of abrasive material arranged in the same longitudinal axis as the impeller or divergent nozzle, i.e. consecutively, and arranged in the area directly under it. The abrasive material is from the collector supplied either into the impeller or the divergent nozzle by means of a relatively short conduit connecting the impeller and divergent nozzle, respectively, with the collector. The abrasive material is through said conduit conveyed in optional mode; e.g. by means of air jet generated by suction effect of the impeller or divergent nozzle and/or supplied by an injection pipe, or by means of a screw conveyer arranged in said conduit.

In general, one embodiment of the device includes an injection blasting diffuser, to the first longitudinal inlet end thereof there being associated a socket, and to the second longitudinal inlet end thereof there being associated a conduit. The free end thereof is closed by a cage-like collector, in the area of connection with said bottom of the collector the conduit being formed with a set of radial recesses. The interiors of the socket and the conduit are mutually interconnected by means of a connection-injection pipe projecting essentially into the conduit through the bottom of the collector.

Another embodiment of the device in accordance with the present invention includes a turbine-like abrading device comprising a stator and, e.g., a pneumatically or electrically driven rotor, a rotational rigid conduit being associated in the axial direction thereto. In the area of its free end the latter is formed with a set of radial recesses. With its first end the conduit is connected to the suction side of the turbine-like device and the second, i.e. free end, of the conduit is connected to the bottom of the cage-like collector. Coaxially with the conduit and with a loose-running fit there is arranged a rotatable loosening tube being linked rigidly with the rotor, at its free end, in the area of the recesses on the conduit, said tube is face-formed with a set of equally spaced loosening teeth.

Still another embodiment of the device according to the invention is characterized by a rotationally rigid tube associated to the rotor in axial direction and piercing the bottom of the collector at the opposite end rigidly connected thereto. Coaxially with said tube there is arranged a rotatable elevator tube provided with a screw conveyer on the inner surface of its wall. The elevator tube is rigidly associated with the rotor and essentially extends longitudinally to the area of the bottom of the collector, between the latter and the free end of the tube there being in each case provided a spacing.

The abrasive blasting device according to the invention can easily be adjusted, e.g., for abrasive blasting of plane surfaces whereby in this embodiment both the abrading turbine and the divergent nozzle, respectively, a well as the collector of the abrasive material are arranged in a suitably adjusted housing. The latter is formed in the area of the abrading turbine and the divergent nozzle, respectively, with a suitable outlet opening for the abrasive material, which is enclosed with a suitable protective shield adapted to the surface treated. The abrasive material is supplied from the area of the bottom of the collector to the abrading turbine or the divergent nozzle by means of a relatively short conduit using one of the aforementioned conveying modes.

All embodiments of the abrasive blasting device in accordance to the invention are characterized in that the part of the mantle wall of the cage-like collector lying axially closer to the abrading device is essentially formed as a radially flexible fine sieve to which, in addition, in ax/al direction there is associated a radially flexible funnel-shaped shield made of elastic material. Said collector of the abrasive material, according to another specific embodiment, can also be formed as a cyclone separator.

Figure 2:
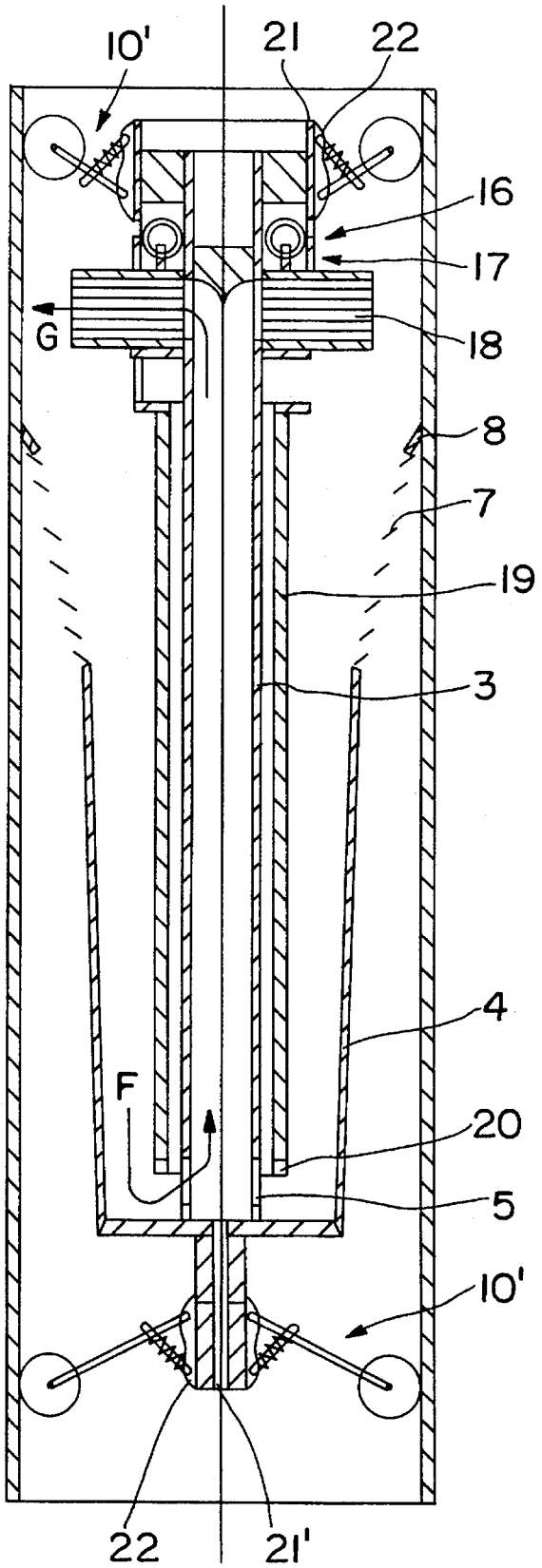
Figure 3:
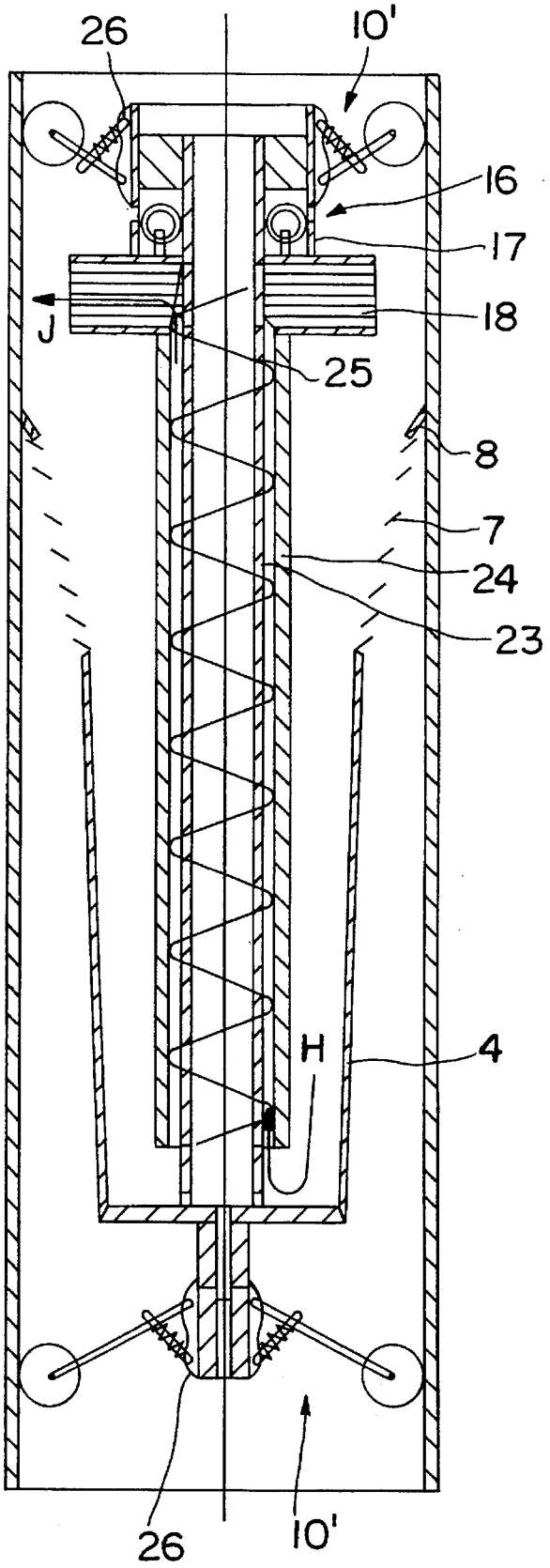
Figure 4:
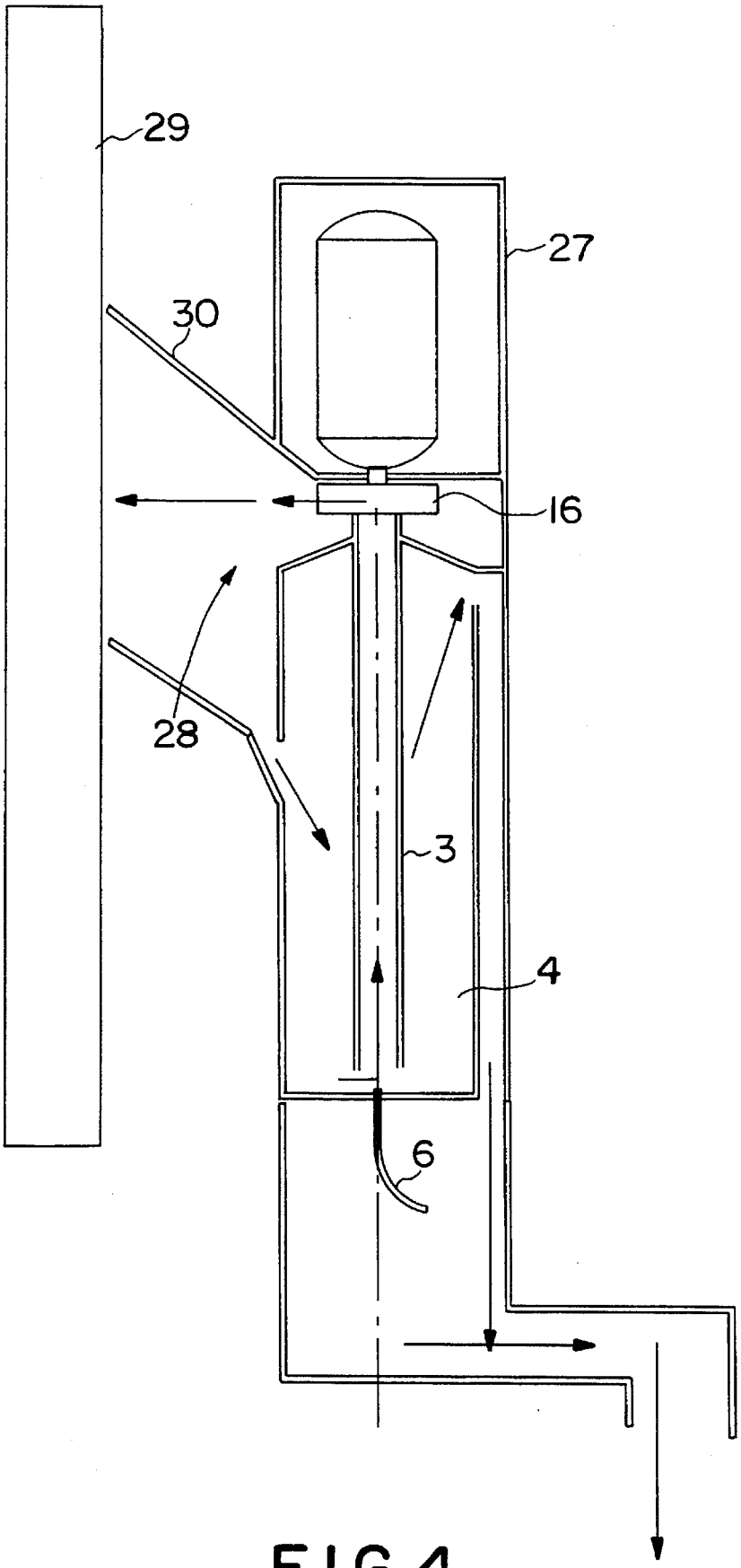

The invention will further be described in connection with the following detailed description of preferred embodiments, reference being made to the accompanying drawings, in which FIG. 1 shows a longitudinal section of a device for internal abrasive blasting, preferably pipes, FIG. 2 shows a longitudinal section of another embodiment of the device of FIG. 1, FIG. 3 shows a longitudinal section of still another embodiment of the device of FIG. 1, FIG. 4 shows a longitudinal section of the device according to the invention in an embodiment for external abrasive blasting of plane surfaces.

On the basis of accompanying drawings an abrasive blasting device in accordance with the invention is shown in a non-restricting manner as a device for internal abrasive blasting of the pipes. Therefore, a man skilled in the art can utilize minimum effort to adapt same to a device for external abrasive blasting of either pipes or different sections, plane workpieces, e.g. ship hulls and similar.

A device, e.g. for internal abrasive blasting of pipes, includes an injection blasting diffuser 1, to the first longitudinal inlet end thereof, i.e. the upper one, there being associated a socket 2. The free end thereof is intended to accept a flexible supply pipe for air-pressure drive, known per se and not shown in the drawing. To the second longitudinal inlet end of the injection diffuser 1, i.e. the lower one, there is associated a conduit 3, the free end whereof is closed with a cage-like collector 4 for an abrasive material in a manner that the conduit 3 is centrically arranged on the bottom of the collector 4 and the mantle wall thereof diverges in the direction towards the diffuser 1. In the area of connection to said bottom of the collector 4, the conduit 3 is formed with a set of radial recesses 5 serving as an inlet for the abrasive material. The interiors of the socket 2 and the conduit 3 are mutually interconnected by means of a connection-injection pipe 6, the latter being to the socket 2 associated in the area of the upper end of the injection diffuser 1 and projecting essentially into the conduit 3 through said bottom of the collector 4.

Observing in axial direction, the part of the mantle wall of the cage-like collector 4 lying closer to the injection diffuser 1 is essentially formed as a radially flexible fine sieve 7 porous only for lightweight particles created at abrasive blasting. Additionally, there is to said sieve in axial direction associated a radially flexible funnel-shaped shield 8 made of elastic material which, at operation of the device according to the invention, abuts tightly against the inner surface of the wall of the pipe 9 to be cleaned.

On the outer surface of the wall of the socket 2 and in the area of its free end there is diametrally opposed arranged a pair of ribs 10 bearing a guide wheel unit 10' in each case. The latter comprises a resilient supported lever 11 pivoted in a manner known per se, in the radial direction of the pipe 9 on whose free end there is rotatably located a supporting wheel 12. Each lever 11 is radially guided by means of a bar-shaped guidance 13 pivoted on each rib 10 whereby a compression spring 14 is slipped on said guidance, said spring being arranged between each lever 11 and the rib 10. Furthermore, on the side of said bottom of the collector 4 averted from radial recesses 5 of the conduit 3 there is located a fastening projection 15 comprising a pair of diametrally opposed ribs 10 bearing the above described wheel unit 10' in each case.

The inner surface of the wall of the pipe 9 is abrasively blasted either horizontally or vertically, namely in a manner that the device according to the invention is moved into said pipe, said device with pairs of wheel unities 10' and radially flexible shield tightly abutting 8 against the wall of the pipe 9. Through the supply pipe not shown in detail the compressed air flow (arrow A) is fed into the socket 2 passing partially through the connection-injection pipe 6 through said bottom of the collector 4 (arrow B). This, so-called primary compressed air flow, moreover sucks the abrasive material through the radial recesses 5 of the conduit 3 and pushes same through the latter upwards. This operation is supported by the secondary compressed air flow, i.e. the compressed air flow remaining in the socket 2 after the primary compressed air flow has passed off through the connection-injection pipe 6. Moreover, the secondary flow of compressed air flows through the diffuser 1 (arrow C) creating additional pressure in the collector 4 which, as already mentioned, additionally pushes the abrasive material through the recesses 5 (arrow D). The secondary compressed air flow passing through the diffuser 1 also excites an additional pressure in the conduit 3, therefore additionally accelerating the flow of the abrasive material thrown radially into contact with the internal surface of the pipe 9 (arrow E) by the fast compressed air flow. Subsequently, the abrasive material falls into the collector 4 and the lightweight particles are by means of compressed air flow forced to pass through the fine sieve 7. The abrasive blasting device according to the invention is moved along the pipe 9 until its entire length has been cleaned.

Another embodiment of the device in accordance with the invention includes a turbine-like abrading device 16 comprising a stator 17 and a pneumatically driven rotor 18 (not shown in detail in FIG. 2). In axial direction there is to the rotor 18 associated a rotational rigid conduit 3, which is in the same way as described in the foregoing embodiment, in the area of its free end formed with a set of radial recesses 5, and which is with its first end fixed to the suction end of the turbine device 16. The second, i.e. the free end, of the conduit 3 is fixed to the bottom of the cage-like collector 4 to which there is as in the first embodiment associated an essentially radially flexible fine sieve 7, which is porous only for lightweight particles created at abrasive blasting. Axially to said sieve 7 there is further associated a radially flexible funnel-shaped shield 8 made of elastic material which, in the operation of the device according to the invention, abuts tightly against the inner surface of the wall of the pipe 9 to be cleaned.

Coaxially with the conduit 3 and with a loose-running fit there is arranged a rotatable loosening tube 19 rigidly linked with the rotor 18. At its free end, i.e. in the area of recesses 5 on conduit 3, said tube 19 is face-formed with a set of equally spaced loosening teeth 20. The collector 4 is on the side of the bottom averted from the recesses 5 on the conduit 3, and the stator 17 is on the side averted from the suction side of the turbine device 16 in each case formed with a projection 21, 21', each comprising a pair of radially projecting ribs 22, each bearing a wheel unit 10' mentioned above.

Also according to this second embodiment, the inner surface of the pipe 9 is abrasively blasted essentially in vertical position. The abrasive blasting device according to the invention is arranged in said pipe 9 in a manner that said device with pairs of wheel units 10' and radially flexible shield 8 tightly abuts against the wall of the pipe 9. Simultaneously with the rotor 18 of the turbine device 16, there starts to rotate the loosening tube 19 which with a set of loosening teeth 20 whirls and loosens the abrasive material contained in the collector 4. Besides, the rotation of the rotor 18 causes a pressure drop in the conduit 3 whereby the abrasive material is sucked therein (arrow F) and further sucked into the rotor 18 and thrown radially into contact with the internal surface of the pipe 9 (arrow G) by means of vanes. Subsequently, the abrasive material falls into the collector 4 and the lightweight particles are by means of the air flow forced to pass through the fine sieve 7. The abrasive blasting device according to the invention is moved along the pipe 9 until its entire length has been cleaned.

Another embodiment of the device for internal abrasive blasting according to the invention consists of a turbine-like abrading device 16 known per se, comprising a stator 17 and, e.g., a pneumatically or electrically driven rotor 18 (not shown in detail in FIG. 3). To the rotor 18 there is in the axial direction associated a rotationally rigid tube 23 piercing the bottom of the collector 4 at the opposite end and rigidly connected thereto. To the collector 4 there is in the same way as described in the two foregoing embodiments associated an essentially radially flexible fine sieve 7 which is porous only for lightweight particles created at abrasive blasting. Further there is axially to said sieve 7 associated a radially flexible funnel-shaped shield 8 made of elastic material which, at operation of the device according to the invention, tightly abuts against the inner surface of the wall of the pipe 9 to be cleaned. Coaxially with the tube 23 there is arranged a rotatable elevation tube 24 provided with a screw conveyer 25 on the inner surface of its wall and rigidly associated with the rotor 18. The elevation tube 24 extends longitudinally essentially to the area of the bottom of the collector 4, between the latter and the free end of the tube 24 there being in each case provided a spacing allowing free passage for the abrasive material.

The collector 4 is on the side averted from the free end of the elevation tube 24 and the stator 17 is on the side averted from the suction side of the device 16 in each case formed with a pair of radially projecting ribs 26, each bearing the aforementioned wheel unit 10'.

As is evident from both examples described above, also according to this embodiment the inner surface of the pipe 9 is abrasively blasted essentially in the vertical position. The abrasive blasting device according to the invention is arranged in said pipe 9 in a manner that said device with pairs of wheel unities 10' and radially flexible shield 8 tightly abuts against the wall of the pipe 9. Simultaneously with the rotor 18 of the turbine device 16 there starts to rotate the elevation tube 24 with the screw conveyer 25, conveying the abrasive material contained in the collector 4 into the turbine device 16 (arrow H). Rotation of the rotor 18 causes abrasive material to be thrown radially into contact with the internal surface of the pipe 9 (arrow J) by means of vanes. Subsequently, the abrasive material falls into the collector 4 and the lightweight particles are by means of the air flow forced to pass through the fine sieve 7. The abrasive blasting device according to the invention is moved along the pipe 9 until its entire length has been cleaned.

The abrasive blasting device according to the invention can easily be adjusted, e.g. for abrasive blasting of plane surfaces. However, in this embodiment both the abrading turbine 16 and the divergent nozzle 1, respectively, and the collector 4 of the abrasive material are arranged in a suitably adjusted housing 27. The latter is in the area of the abrading turbine 16 and divergent nozzle 1, respectively, formed with a suitable outlet opening 28 for the abrasive material, which is enclosed with a suitable protective shield 30 adapted to the surface 29 to be treated. In order to prevent the abrasive material to leak into the ambient the protective shield 30 tightly fits the surface 29 to be treated. The lower part of the protective shield is formed as a chute to allow abrasive material having performed its task to slip back into the collector 4. The abrasive material passes from the area of the bottom of the collector 4 to the abrading turbine 16 or the divergent nozzle 1 by means of a relatively short conduit 3 using one of the aforementioned conveying modes.

The operation of the device for abrasive blasting of external surfaces is practically the same as according to embodiments described in the foregoing, therefore there is no need for repetition of the described.

In all embodiments the lightweight particles are exhausted by means of dust collector known per se and not shown in the drawing, which has to create below atmospheric pressure either in the pipe 9 to be cleaned or in the housing 27 in order to prevent dusting of the ambient. In all examples the collector 4 can also be formed as a cyclone separator.

The abrasive blasting device according to the invention can be efficiently applied for internal blasting, particularly of pipes, as described in the foregoing, by referring to examples of the embodiment. However, a device according to the invention can with constructional measures not exceeding the scope of the invention applied in another field of work as, e.g., external abrasive blasting of pipes, different structural shapes, sheets (e.g. ship hulls), and similar. With the device in accordance to the invention the energy consumption decreased surprisingly, even three to four times. This means that at the same time the costs of the abrasive blasting per sq. meter of the surface to be cleaned are reduced, in comparison with the devices according to prior art savings can reach even 95%.

We claim:

1. An abrasive blasting device comprising: means for throwing abrasive material generally radially outwardly relative to a longitudinal axis of said device to a surface of a workpiece, characterized by collector means of the abrasive material being arranged directly under said abrasive throwing means for collecting the abrasive materials; said collecting means includes sieve means having an axis which is generally coaxial with said longitudinal axis of said throwing means for collecting abrasive particles after the particles have been impinged against the workpiece surface; conduit means being generally coaxial with said longitudinal axis for connecting a bottom of said collector means with said abrasive throwing means so that abrasive material can be conveyed from the bottom of said collector means to said abrasive throwing means; and, conveying means operative for conveying abrasive material in the bottom of said collector means to said abrasive throwing means.

2. The abrasive blasting device according to claim 1, wherein said throwing means includes an injection blasting diffuser having a first longitudinal inlet end with a socket, and a second longitudinal inlet end, said conduit means extending from said second longitudinal inlet end and being connected to said bottom of said collector means, said collector means including a mantle wall surrounding said conduit means and diverging in a direction towards said diffuser, said conduit means including a set of radial openings at the area of connection to said bottom of said collector means; and interiors of said socket and said conduit means being interconnected by a pipe extending through said bottom of said collector means, and on an outer surface of said socket adjacent said first longitudinal inlet and there being diametrically opposed ribs each bearing a guide wheel unit.

3. The abrasive blasting device according to claim 1, wherein said throwing means includes a rotor having axially coupled thereto said conduit means, with said conduit means being connected to said bottom of said collector means; and further includingg a rotatable elevator tube provided with a screw conveyor therein surrounding said conduit means, said elevator tube being connected to said rotor, and said screw extending longitudinally from said rotor ot just above said bottom of said collector means.

4. The abrasive blasting device according to claim 1, wherein said seive means is a radially flexible fine sieve extending from a top portion of said collector means to an area beneath said throwing means, and including at an upper portion thereof a radially flexible funnel-shaped shield made of elastic material.

5. The abrasive blasting device according to claim 4, wherein said collector means is a cyclone separator.

6. The abrasive blasting device according to claim 1, and including a member connected to and extending downwardly from said bottom of said collecting means; and a plurality of guide wheel units connected to each of said throwing means and said member, with each guide wheel unit including a rib attached to each of said throwing means and member, respectively, a lever pivotally attached to said rib, a wheel attached to a free end of said lever, a bar pivotally attached to said rib and interconnected with said lever, and a compression spring surrounding said bar and located between said lever and said rib.

7. An abrasive blasting device comprising: means for throwing abrasive material generally radially outwardly relative to a longitudinal axis of said device to a surface of a workpiece, characterized by collector means of the abrasive material being arranged directly under said abrasive throwing means; conduit means being generally coaxial with said longitudinal axis for connecting a bottom of said collector means with said abrasive throwing means so that abrasive material can be conveyed from the bottom of said collector means to said abrasive throwing means; and, conveying means operative for conveying abrasive material in the bottom of said collector means to said abrasive throwing means; said throwing means includes turbine means comprising a rotor which is coupled in an axial direction along said longitudinal axis to said conduit means, said conduit means having at a free end thereof a set of radial recesses and its first end being connected to a suction side of said turbine means, said free end of said conduit means being connected to said bottom of said collector means; and said conveying means including a rotatable loosening tube being linked rigidly with said rotor, said loosening tube having a loose-running fit relative to said conduit means as well as being coaxially arranged to said longitudinal axis; said tube being formed with a set of generally equally spaced loosening teeth; said collector means at a side of its bottom being averted from said recesses; and a stator of said turbine means averted from a suction side of said turbine means being formed with at least a projection means; each of said projection means includes a pair of radially projecting rib portions, each of said rib portion bearing a wheel assembly.

* * * * *